US006468395B1

(12) United States Patent
Chao et al.

(10) Patent No.: US 6,468,395 B1
(45) Date of Patent: Oct. 22, 2002

(54) BASECOATED SUBSTRATE FOR AN INKJET RECORDING SHEET

(75) Inventors: Hung-Tai Chao, Cumberland; Michael L. DeMatte, Columbia, both of MD (US)

(73) Assignee: MeadWestvaco Corporation, Stamford, CT (US)

( * ) Notice: Subject to any disclaimer, the term of this patent is extended or adjusted under 35 U.S.C. 154(b) by 218 days.

(21) Appl. No.: 09/649,956

(22) Filed: Aug. 29, 2000

Related U.S. Application Data

(62) Division of application No. 09/305,922, filed on May 6, 1999, now Pat. No. 6,203,894.

(51) Int. Cl.[7] ..... D21F 11/00

(52) U.S. Cl. ..... 162/136; 162/135; 162/181.8; 428/317.9; 428/330; 428/331; 428/342; 427/391; 427/411; 427/414; 427/415; 427/150; 427/151; 427/152; 503/200; 503/227; 106/486; 106/487

(58) Field of Search ..... 162/136, 135, 162/181.8; 428/317.9, 330, 331, 342, 537.5; 427/391, 411, 414, 415, 150–2; 503/200, 227; 106/486, 487

(56) References Cited

U.S. PATENT DOCUMENTS

| | | | | |
|---|---|---|---|---|
| 4,474,847 | A | 10/1984 | Schroder et al. | 428/323 |
| 5,152,835 | A | 10/1992 | Nemeh | 106/437 |
| 5,171,626 | A | 12/1992 | Nagamine et al. | 428/212 |
| 5,609,964 | A | 3/1997 | Ogawa et al. | 428/520 |
| 5,670,242 | A | 9/1997 | Asano et al. | 428/212 |
| 5,747,148 | A | 5/1998 | Warner et al. | 428/212 |
| 5,755,871 | A | 5/1998 | Husson, Sr. | 106/487 |
| 5,759,673 | A | 6/1998 | Ikezawa et al. | 428/198 |

*Primary Examiner*—Steven P. Griffin
*Assistant Examiner*—Mark Halpern
(74) *Attorney, Agent, or Firm*—Donald L. Bowman; Richard L. Schmalz

(57) ABSTRACT

The inkjet recording sheet substrate of the present invention comprises a cellulosic sheet support, e.g., paper, having on at least one surface thereof a base coating comprising pigment and binder. The preferred pigment component is a 50/50 mixture of kaolin clay and calcined clay, and the preferred binder component is polyvinyl acetate. This combination of binder and pigment has been found to possess a high absorption capacity for the vehicle of an inkjet ink and good compatibility with ink receptive top coatings applied over the base coat.

4 Claims, No Drawings

BASECOATED SUBSTRATE FOR AN INKJET RECORDING SHEET

This application is filed as a division of application Ser. No. 09/305,922, filed May 6, 1999, now U.S. Pat. No. 6,203,894.

BACKGROUND OF INVENTION

The present invention relates generally to a paper substrate for an inkjet recording sheet, and more particularly to a basecoated paper substrate designed to accommodate an ink receptive coating.

Conventional inkjet recording sheets are prepared by coating a paper surface with a coating composition containing a porous fine pigment in a binder capable of accepting and retaining the ink on the surface of the paper, while the paper absorbs the ink vehicle. However, in some instances the paper is unable to instantaneously absorb the entire amount of the ink vehicle. This drawback often results in spreading of the ink drops, which creates resolution and sharpness defects, and unduly long drying times.

It is known that inkjet recording paper may be improved by first applying a suitable base coat having good absorption characteristics to the paper, before applying the ink receptive top coat. Such base coatings must possess a balance between good coating holdout and adequate water absorbency. It has also been discovered that such basecoats must be compatible with the subsequently applied ink receptive top coatings for good runnability and performance during manufacture.

Substrates for inkjet recording sheets must rapidly absorb the vehicle of the inks to reduce drying time with little or no backside show-through. Further, the substrate plays a role in preventing diffusion of ink laterally on the surface of the recording sheet in order to achieve high resolution without blurring. Thus, for obtaining color images having good color density and resolution, with good absorptivity and water fastness as well as optical brightness, the substrate plays an important role. Paper substrates for ink receptive coatings are generally made from bleached chemical pulp to which fillers, dyes, and if required, sizing agents and strength enhancers are added. An example of a typical paper substrate for use in the manufacture of an inkjet recording sheet is disclosed in pending U. S. patent application Ser. No. 09/020,826 filed Feb. 9, 1998, now U.S. Pat. No. 5,985,424 owned by the present assignee herein.

It is also known that paper substrates for inkjet recording can be improved by applying a basecoat to the paper before applying the ink receptive top coating. Such base coats generally comprise a pigment and binder to provide a surface having a porous structure which has good absorptivity for the ink vehicle. Examples of base coatings for inkjet recording sheets are disclosed, for example, in prior U.S. Pat. Nos. 4,474,847; 5,171,626; 5,670,242; 5,747,148; and 5,759,673. In particular, the '242 patent discloses typical examples of the materials useful for the base coatings of inkjet recording sheets to include various known pigments used in ordinary coated papers, such as kaolin clay, calcined clay, amorphous silica, zinc oxide, aluminum oxide, aluminum hydroxide, calcium carbonate, satin white, aluminum silicate, smectite, magnesium silicate, magnesium carbonate, magnesium oxide and others. However, in practice, the most often used pigments for such basecoats comprise clay, calcium carbonate, amorphous silica and aluminum oxide. Another requirement of the basecoat is that the coating components not interfere in any way with the top coatings which provide the ink receptive surface for such products. Where adverse reactions occur, the base coat components must be changed or altered.

SUMMARY OF INVENTION

In the aforementioned pending U.S. patent application Ser. No. 09/020,826, a base coating is disclosed which comprises as the coating pigment precipitated calcium carbonate, calcined clay, and, if desired, titanium dioxide. Polyvinyl acetate is disclosed as the preferred binder. This base coating has been found to be compatible with most top coatings, and when combined with a top coating containing fumed silica, achieved satisfactory printing results with regard to ink bleed, drying time and gamut characteristics. However, the same base coating produced undesirable interactions when used with other top coatings. It was observed that the precipitated calcium carbonate in the above described base coating had a tendency to destabilize top coatings which were acidic in nature. Thus to overcome this interaction, and to provide a more universally acceptable base coating, the pigment combination disclosed herein was adopted. By substituting a kaolin clay based pigment in place of the precipitated calcium carbonate pigment utilized in the above described base coating and increasing the calcined clay content, the destabilization mentioned above with the use of acidic top coatings was averted while still achieving the desired inkjet printing characteristics.

Thus while it was heretofore known that the selection of a suitable base coating is necessary to obtain proper inter color bleed, gamut and ink drying time of the final sheet, it has now been found by the present invention that the proper selection of the base coating components is also necessary to prevent any undesirable interactions between the base coating and the top coating during the manufacturing process.

It is, therefore, a general object of the present invention to provide a basecoated substrate for an inkjet recording sheet that has superior performance during inkjet printing.

It is a further object of the invention to provide a coated paper basestock for an inkjet recording sheet which has excellent dimensional stability when used with aqueous based inks.

A further object of the present invention is to provide a base coating for a substrate useful in the manufacture of inkjet printing paper that has little or no adverse interaction with the top coatings applied thereto.

DETAILED DESCRIPTION

The basecoated substrate of the present invention achieves enhanced properties vis-a-vis inkjet printing performance as a result of a combination of rawstock properties and base coating. The substrate is preferably alkaline paper having a basis weight in the range of from about 100–150 $g/m^2$ and a caliper of about 5.0 mil. The substrate is prepared from a bleached chemical wood pulp furnish to which there is added a sizing agent such as alkylketene dimer, and fillers such as precipitated calcium carbonate and kaolin clay. The substrate is further preferably size pressed with a mixture of starch and styrene maleic anhydride in a conventional manner. The size pressed substrate has a Tappi brightness of about 85%, a Tappi opacity of about 93%, Sheffield smoothness of about 150 sec, and a Hercules size of 300–500 seconds (10% formic acid).

The base coating of the present invention comprises essentially pigment and binder. The pigment component is essentially 100% clay and may consist of from about 40–60% kaolin clay and 60–40% calcined clay. In a preferred embodiment, the pigment component comprises a 50/50 mixture of kaolin clay and calcined clay. An example of the kaolin clay useful in the invention is sold under the trademark COVERGLOSS by J. M. Huber Corporation. An example of the calcined clay useful in the invention is sold under the trademark ANSILEX by Engelhard Corporation. Both the kaolin clay and calcined clay have an average particle size in the range of from about 0.5–0.6 micron. The coating binder is preferably polyvinyl acetate, but other binders of the type used in such coatings could be substituted. The solids content of the coating is preferably less than about 60% at a viscosity of from about 1500–2000 cps Brookfield, No. 2 spindle, for application using conventional coating apparatus on a high speed papermachine. The Gurley porosity of a basestock sample of the present invention is between about 200–800 sec/50 cc. A preferred product would be coated each side with from about 6–10 lb/ream (ream size 3300 $ft^2$).

As indicated above, the preferred pigment mixture for the present invention comprises about 50 parts kaolin clay and 50 parts calcined clay, where the average particle size of each pigment component is within the same range. This pigment combination provides a generally acceptable basecoat useful with a variety of ink receptive top coats.

A unique feature of the present invention is the use of calcined clay. Calcined clays are, in general, difficult to work with in paper coatings, and have in the past been best known for use as extenders for titanium dioxide, where the titanium dioxide component of the coating is small. However, calcined clay provides a substantial increase in the porosity of the base coating, particularly within the preferred particle size range of from about 0.5–0.6 micron, and is a worthy substitute for the precipitated calcium carbonate normally used in such base coatings.

Calcined clays are well known as conventional coating components for lightweight printing papers and the like, particularly as disclosed in U.S. Pat. Nos. 5,152,834 and 5,755,871. The '834 patent discloses a composite pigment comprising weight ratios of from 30:70 to 70:30 of titanium dioxide and calcined clay, and the '871 patent discloses a high brightness coating composition with a major portion of hydrous kaolin clay and a minor portion of a calcined clay where the calcined clay component comprises only about 15–30 dry parts. However, to the best of applicants' knowledge, there is no known use of calcined clays in commercial inkjet printing papers particularly in the elevated amounts used herein. Accordingly, the combination of kaolin clay and calcined clay in a base coating for an inkjet recording paper as disclosed herein is believed to be novel.

It will be apparent to those skilled in the art that various modifications and variations can be made in the present invention without departing from the scope or spirit thereof as defined in the appended claims. Other embodiments of the invention will be apparent to those skilled in the art from a consideration of the specification and practice of the invention disclosed herein. It is intended that the specification and examples be considered as exemplary only, with the true scope and spirit of the invention being indicated by the following claims.

What is claimed is:

1. A method of forming an inkjet recording sheet comprising:

a) providing a substrate comprising wood pulp;

b) applying to the substrate a base coating composition comprising from about 40% to about–60% kaolin clay and from about 60% to about 40% calcined clay; to provide a basestock having a Gurley porosity of from about 200 sec/50 cc to about 800 sec/50 cc; and c) combining the basestock with at least one ink-receptive top coating; to form an inkjet recording sheet in which undesirable interactions between the base coating composition of the basestock and the top coating are prevented.

2. The method of claim 1, wherein the base coating composition is applied to the substrate at about 6–10 lb./ream (ream size 3300 $ft^2$).

3. An inkjet recording medium formed by the method of claim 1.

4. An inkjet recording medium formed by the method of claim 2.

* * * * *